US006103160A

United States Patent [19]

Uchida et al.

[11] Patent Number: 6,103,160

[45] Date of Patent: Aug. 15, 2000

[54] METHOD FOR PRODUCING PATTERNED SHAPED ARTICLES

[75] Inventors: Hiroshi Uchida, Ashikaga; Kiyoshi Naruse, Oota; Ichiro Sando, Ashikaga, all of Japan

[73] Assignee: CCA Inc., Tokyo, Japan

[21] Appl. No.: 09/266,632

[22] Filed: Mar. 11, 1999

[30] Foreign Application Priority Data

Mar. 12, 1998 [JP] Japan ..... 10-060962

[51] Int. Cl.[7] ..... D04H 1/16

[52] U.S. Cl. ..... 264/113; 264/112; 264/245

[58] Field of Search ..... 264/112, 113, 264/245

[56] References Cited

U.S. PATENT DOCUMENTS

| | | | |
|---|---|---|---|
| 5,368,791 | 11/1994 | Uchida et al. | 264/35 |
| 5,376,321 | 12/1994 | Uchida et al. | 264/60 |
| 5,429,676 | 7/1995 | Uchida et al. | 118/310 |
| 5,445,772 | 8/1995 | Uchida et al. | 264/32 |
| 5,624,510 | 4/1997 | Uchida et al. | 156/62.2 |
| 5,665,299 | 9/1997 | Uchida et al. | 264/510 |
| 5,736,084 | 4/1998 | Uchida et al. | 264/112 |
| 5,833,907 | 11/1998 | Uchida et at. | 264/245 |

*Primary Examiner*—Mary Lynn Theisen

*Attorney, Agent, or Firm*—Oblon, Spivak, McClelland, Maier & Neustadt, P.C.

[57] ABSTRACT

A method for producing a patterned shaped article includes the steps of disposing on a base surface a retainer having a plurality of particle-retaining spaces; filling the spaces with pre-filling particles having a particle size of not more than 600 $\mu$m and easy to remove; removing the pre-filling particles from part of the spaces to form at least one empty space; filling the at least one empty space with shaped article-forming particles; repeating the step of removing the pre-filling particles and the step of filling the shaped article-forming particles until the shaped particle-forming particles are substituted for all the pre-filling particles, the shaped article-forming particles including at least two kinds of particles; removing the retainer to form a pattern course on the base surface; and allowing the pattern course to set into an integral mass.

3 Claims, 9 Drawing Sheets

METHOD FOR PRODUCING PATTERNED SHAPED ARTICLES

BACKGROUND OF THE INVENTION

1. Field of the Invention

The present invention relates to a method for producing patterned shaped articles using a particle course-forming apparatus. The patterned shaped articles include patterned shaped concrete articles, patterned shaped artificial stone articles, raw products for sintering into patterned shaped ceramic articles, patterned shaped ceramic articles, patterned shaped articles having impasto layers, patterned shaped plastic articles, patterned shaped foodstuffs and the like.

2. Description of the Prior Art

One of the inventors previously proposed various methods for producing patterned shaped articles. One of the methods, using an auxiliary form of a configuration appropriate for a pattern to be expressed, is disclosed in U.S. Pat. No. 5,376,321. Another method is disclosed in U.S. Pat. No. 5,368,791 in which a cell form comprising a plurality of small cylindrical cells which have the equal height and are arranged densely in a contiguous manner is used. Another method uses a projection-bristling form having a support member and a plurality of projections standing upright from the support member, that is disclosed in U.S. Pat. No. 5,445,772.

He further proposed various methods for producing patterned shaped articles, which comprise the steps of overlaying a course of dry particles on a base surface, removing the dry particles at prescribed positions in accordance with a pattern to be expressed using a mask, a suction nozzle, compressed air, a scraper, etc. to form a vacant space, filling the vacant space with a different kind of particles, and allowing or causing all the particles into an integral mass (U.S. Pat. No. 5,833,907; No. 5,576,031; No. 5,662,847; and No. 5,679,298).

There has been an increasing demand for shaped articles having a complicated pattern with diversification of designs and functions. Various materials different in particle size, shape, adhering power, hardness, weight, etc. have been used singly or in combination from the standpoints of design diversification and multifunctionality for producing a patterned shaped article. When a patterned shaped article to be produced is a tile, for example, raw material admixed with pulverized particles of sintered ceramics is used in order to afford slip resistance to the tile. Such ways as this are needed.

Although workers on a job site desire to handle particles for forming a shaped article with a particle size as large as possible, when shaped articles with a more complicated pattern are to be produced in order to satisfy the aforementioned demand, a retainer such as a cell form, a projection-bristling form, etc. has to have a plurality of narrow particle-retaining spaces to express a fine part of the pattern.

As a result, the particle-retaining spaces of a retainer have become narrower, and particles having a size and a shape barely accommodated in the spaces and exhibiting proper adhering power have been used. For this reason, adoption of the conventionally proposed methods using the retainer and particles. requires much time to produce patterned shaped articles and results in low productivity.

In the cases where particles have a large particle size, where particles having a large particle size and particles having a small particle size are combined, and where particles different in shape, adhering power, hardness, weight, etc. are combined into a complicated mixture, it takes much time to remove the particles from a retainer and associated appliances are increasingly damaged and worn off. This results in high cost contrary to a demand for low cost.

The present invention was accomplished in view of the above problems and has as its object to provide a method for rapidly producing multifunctional shaped articles with complicated and various design patterns at low cost with high productivity.

SUMMARY OF THE INVENTION

For achieving the aforesaid object, the method for producing a patterned shaped article according to the present invention comprises the steps of disposing on a base surface a retainer having a plurality of particle-retaining spaces; filling the spaces with pre-filling particles having a particle size of not more than 600 $\mu$m and easy to remove; removing the pre-filling particles from part of the spaces to form at least one empty space; filling the at least one empty space with shaped article-forming particles; repeating the step of removing the pre-filling particles and the step of filling the shaped article-forming particles until the shaped article-forming particles are substituted for all the pre-filling particles, the shaped article-forming particles comprising at least two kinds of particles; removing the retainer to form a pattern course; and allowing the pattern course to set into an integral mass.

A backing layer may be overlaid on the pattern course between the retainer-removing step and the setting step.

Since the present invention uses a retainer having a plurality of small particle-retaining spaces and utilizes small pre-filling particles to attain accurate and rapid removal of the particles, as described above, it is possible to produce a shaped article with a complicated pattern and multifunctionality at low cost with high efficiency and satisfy two desires, contradictory from the standpoint of manufacturing technique, that a minute pattern should be expressed by narrowing the particle-retaining spaces and that particles for forming a shaped article that are large enough to be barely accommodated in the spaces narrowed in view of the particle size, shape, adhering power, hardness, weight, etc. of the particles should be used.

The above object and other objects, and features of the present invention will become apparent from the following description made with reference to the accompanying drawings.

DESCRIPTION OF THE PREFERRED EMBODIMENTS

The method for producing a patterned shaped article according to the present invention comprises the steps of disposing on a base surface a retainer having a plurality of particle-retaining spaces; filling the spaces with pre-filling particles having a particle size of not more than 600 μm and easy to remove; removing the pre-filling particles from part of the spaces to form at least one empty space; filling the at least one empty space with shaped article-forming particles; repeating the step of removing the pre-filling particles and the step of filling the shaped article-forming particles until the shaped article-forming particles are substituted for all the pre-filling particles, the shaped article-forming particles comprising at least two kinds of particles; removing the retainer to form a pattern course; and allowing the pattern course to set with or without a backing layer into an integral mass.

The pre-filling particles used in this invention include dry particles of foodstuffs, stone, coal, bones, shells, soil, clay, glass, ceramic, metal, plastic, compounds, chemicals, fibers, and skins; ash; powdered paint, cement powder; wood chips; paper scraps; and the like.

Since the removal of the pre-filling particles is effected every one particle-retaining space, it has to be performed as rapidly and accurately as possible. The pre-filling particles having a particle size of not more than 600 μm exhibit high fluidity. By using the pre-filling particles having this particle size, therefore, the pre-filling particles within the narrow spaces can be rapidly removed with exactitude, thereby enabling even a complicated pattern to be expressed with high precision.

The pre-filling particles are obtained by classifying the particles existing in the natural world or crushing the conventionally used particles with a prior art crusher into particles of not more than 600 μm, those of not more than 300 μm and those of not more than 100 μm.

The shaped article-forming particles used in this invention are dry particles that may contain, but are not kneaded with, at least one of water, oil, solvent, lubricant-bonding agent, plasticizer and setting agent and is in a state readily amenable to pulverization before supplying. They may further contain various kinds of additives to afford adhering power or other functions to a patterned shaped article to be produced.

The removal of the pre-filling particles is performed every one particle-retaining space at high speed as described above to form empty spaces. For this reason, the pre-filling particles are required to have high fluidity. However, since the shaped article-forming particles can be supplied at a time to a prescribed number of empty spaces, they are required to have lower fluidity than the pre-filling particles. Of these low-fluidity particles, there are many ones indispensable to diversification of pattern designs.

Figure 2:
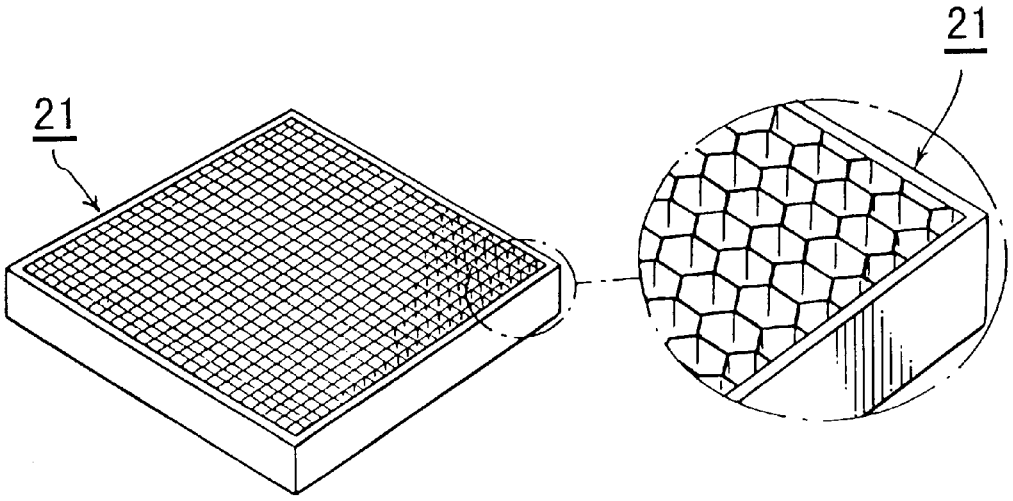
FIG. 2 is a perspective view showing one example of a retainer used in the method, with an inset showing a partial enlarged perspective view of the retainer.
Figure 7:
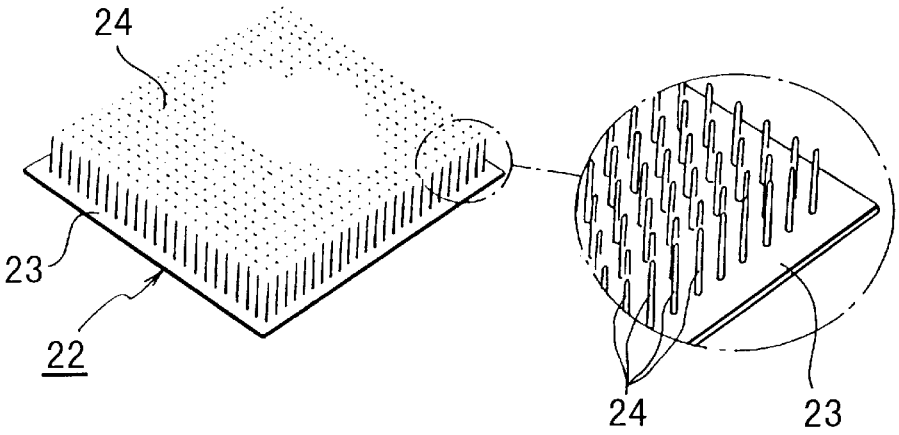
FIG. 7 is a perspective view showing another example of the retainer, with an inset showing a partial enlarged perspective view of the retainer.

The retainer used in this invention is one or both of a cell form 21 as shown in FIG. 2 and a projection-bristling form 22 as shown in FIG. 7. The retainer is supported on a pattern course-forming apparatus in sheet form, vertically and laterally movable form, endless form or form capable of turning upside down.

The pre-filling particles are removed by means of suction and/or blowing. A cycle of the removal of the pre-filling particles and supply of the shaped article-producing particles is repeated to form a pattern course.

Since the pattern course-forming apparatus can be used in combination with a mask, other equipment, auxiliaries thereto, etc., various combinations will make it possible to carry out various methods and express various patterns. Thus, the present invention should not be limited to the embodiments described hereinafter.

FIG. 1 through FIG. 6 illustrate one embodiment of the method for producing a patterned shaped article according to the present invention.

Figure 1:
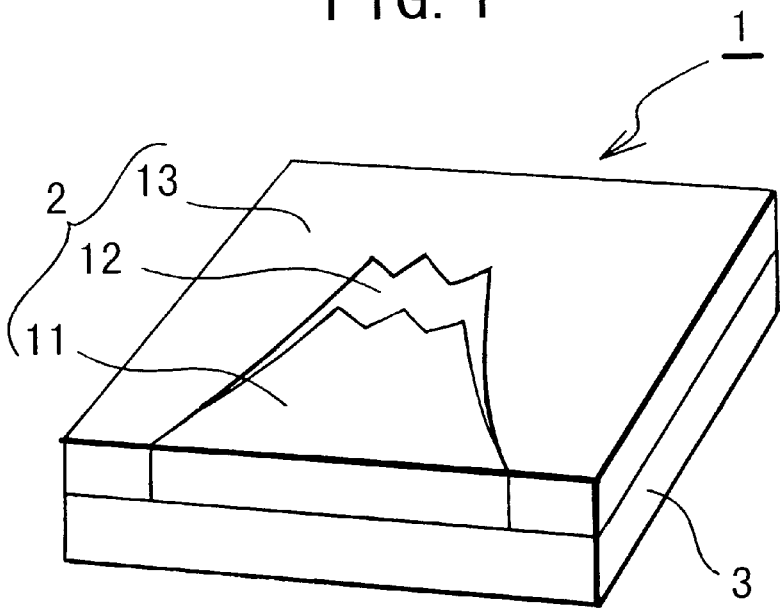
FIG. 1 is a perspective view showing a patterned shaped article obtained by a first embodiment of a patterned shaped article producing method according to the present invention.

A shaped article 1 shown in FIG. 1 is produced by a first embodiment of the invention and comprises a pattern course 2 expressing Mt. Fuji and a backing layer 3 on the lower side (back surface) of the pattern course 2. The pattern course 2 is formed of a mixture of material once set and then pulverized into relatively large particles and a different kind of material having small particle size. The backing layer 3 is formed of a different type of material.

Figure 3:
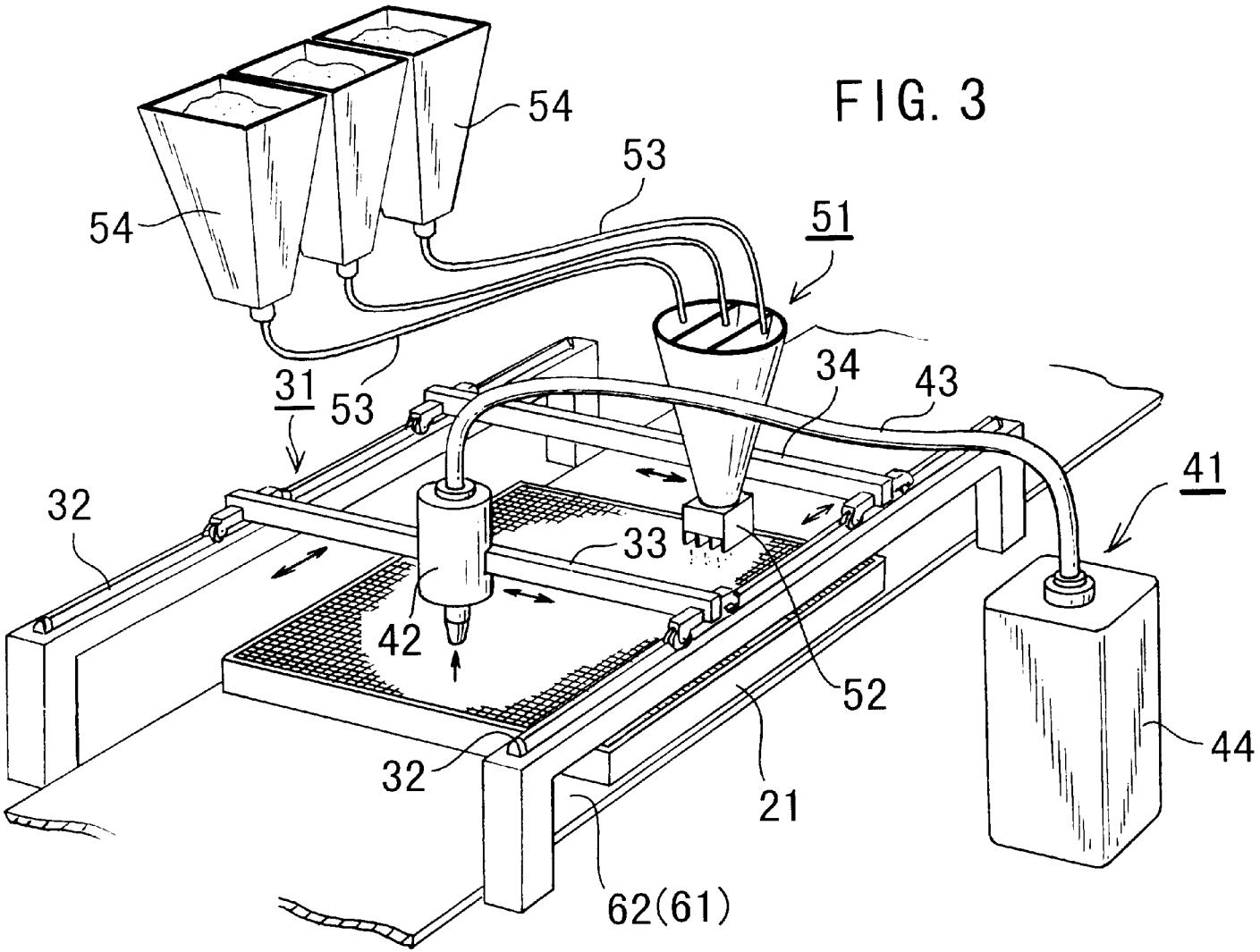
FIG. 3 is a schematic perspective view showing one example of an apparatus for carrying out the first embodiment of the method.
Figure 4A:
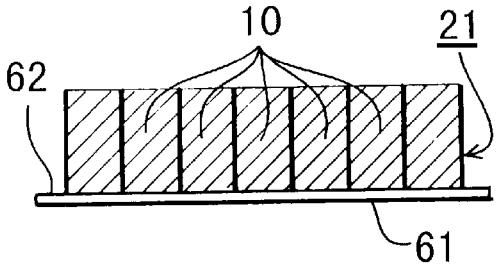
FIG. 4 is an explanatory view showing sequential steps of the method, FIG. 4(*a*) showing a state wherein spaces of the retainer were filled with pre-filling particles, FIG. 4(*b*) a state wherein part of the pre-filling particles was removed from some spaces, FIG. 4(*c*) a state wherein the some spaces were filled with first shaped article-forming particles, FIG. 4(*d*) a state wherein another part of the pre-filling particles was removed from different some spaces, FIG. 4(*e*) a state wherein the different some spaces were filled with second shaped article-forming particles, FIG. 4(*f*) a state wherein still another part of the pre-filling particles was removed from still different some spaces, FIG. 4(*g*) a state wherein the still different some spaces were filled with third shaped article-forming particles, FIG. 4(*h*) a state wherein the retainer was removed to form a pattern course on a base surface, and FIG. 4(*i*) a state wherein a backing layer was overlaid on the pattern course.
Figure 4B:
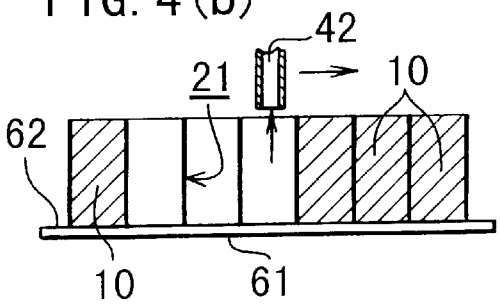
Figure 4C:
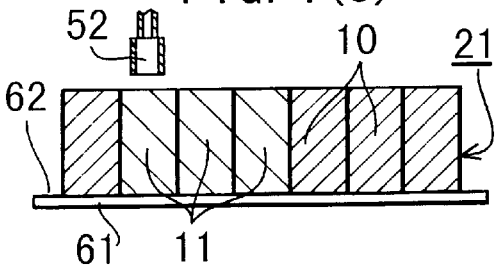
Figure 4D:
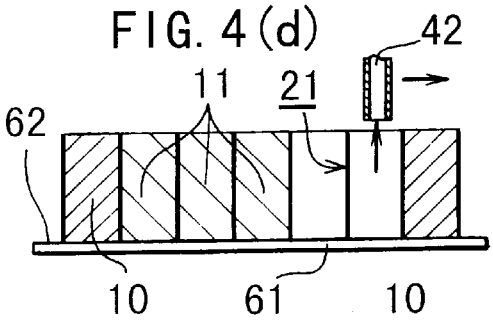
Figure 4E:
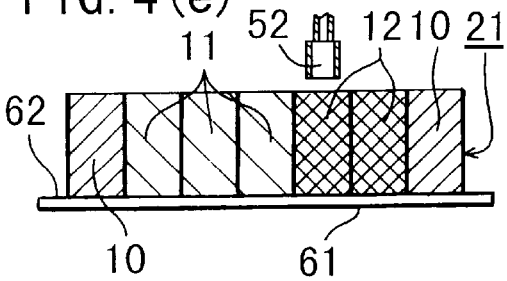
Figure 4F:
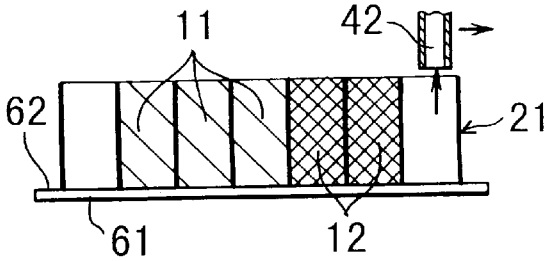
Figure 4G:
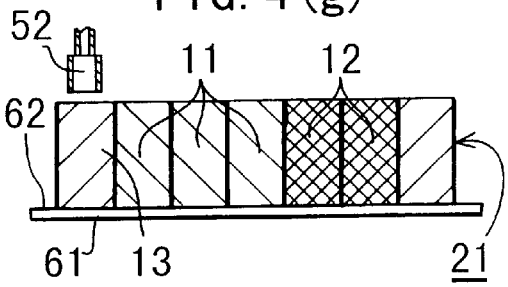
Figure 4H:
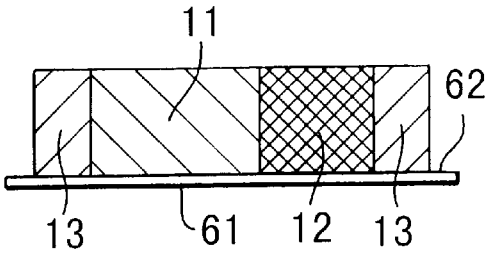
Figure 4I:
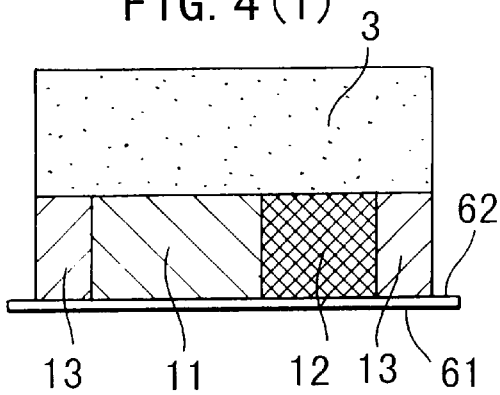
Figure 5:
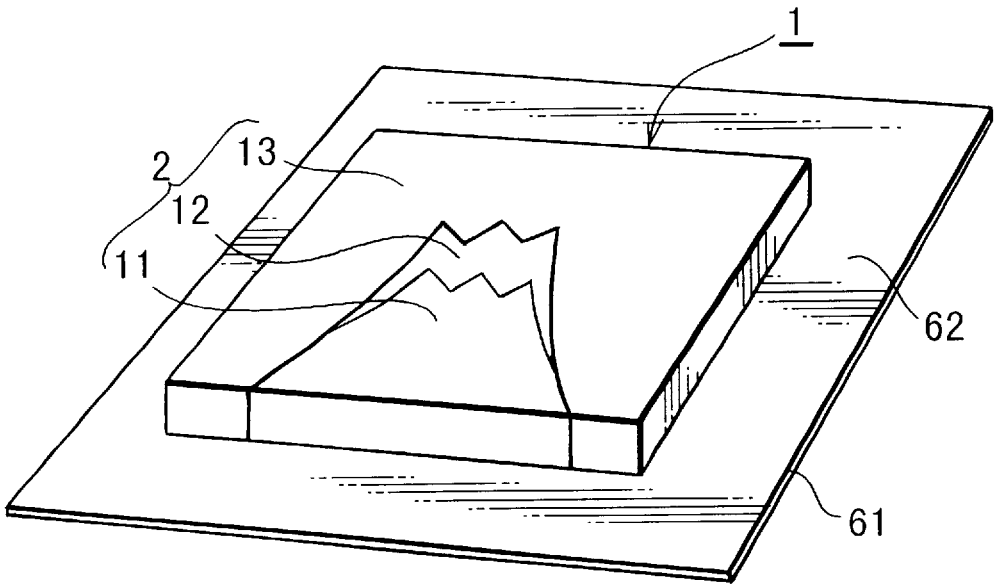
FIG. 5 is a perspective view showing the pattern course formed on the base surface.
Figure 6:
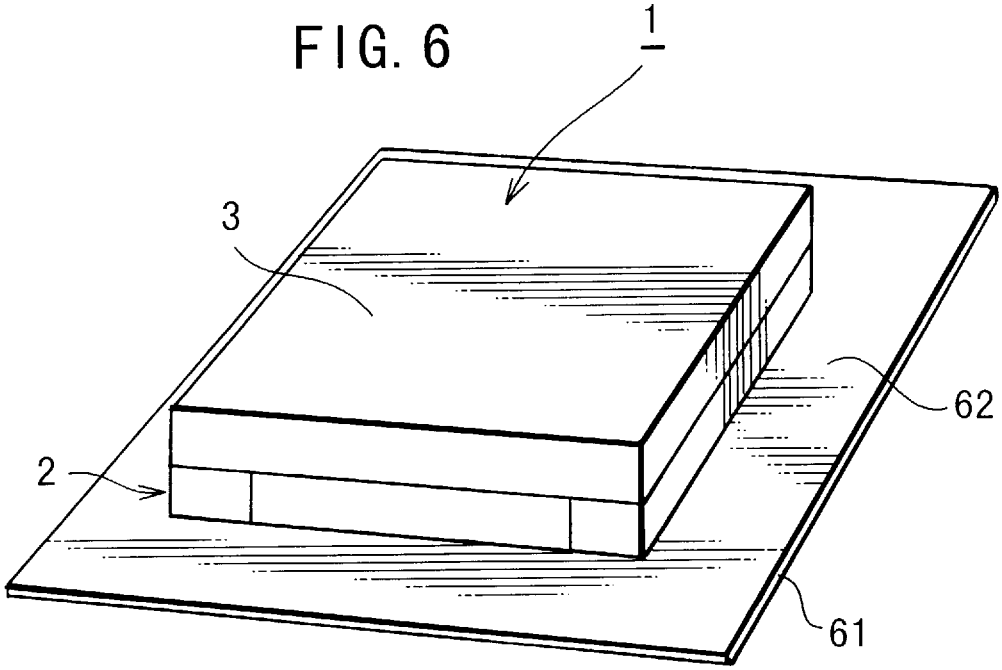
FIG. 6 is a perspective view showing the backing layer overlaid on the pattern course.

One example of an apparatus for performing the first embodiment is shown in FIG. 3 and comprises a scanner 31, a suction device 41 and a particle-supplying device 51.

The scanner 31 comprises two parallel guide rails 32, a pair of support bars 33 and 34 each bridging the guide rails 32, bar-driving means (not shown) for moving the support bars 33 and 34 along the guide rails 32.

The cell form 21 (retainer) having a plurality of cells (particle retaining spaces) densely arranged in a contiguous manner is disposed on a base surface 62 between the two guide rails 32.

The suction device 41 comprises a suction nozzle 42 movably mounted on the support bar 33, a hose 43 having one end thereof connected to the particle-discharging side of the suction nozzle 42, particle recovery means 44 to which the opposite end of the hose 43 is connected, and suction control means (not shown) for controlling air suction and suction termination.

The particle-supplying device 51 comprises a supply nozzle 52 provided with a plurality of supply ports and movably mounted on the support rod 34, a plurality of hoses 53 each having one end thereof connected to the particle-charging side of the supply nozzle 52, supply hoppers 54 to each of which the opposite end of each hose 53 is connected, and control means (not shown) for controlling supply of the shaped article-forming particles and supply termination.

The method for producing the pattered shaped article 1 shown in FIG. 1 will now be described with reference to FIG. 4.

First, as shown in FIG. 4(*a*), pre-filling particles 10 are filled in particle-retaining spaces (cells) of the retainer 21 (cell form) disposed on a base surface 62 of a support plate 61 using a given particle-supplying device (not shown). The pre-filling particles 10 existing in the cells corresponding to the side of Mt. Fuji (FIG. 1) are then removed via the suction nozzle 42 as shown in FIG. 4(*b*) by operating the scanner 31 while continuing and stopping the operation of the suction device 41.

In removing the pre-filling particles 10 from the cells of the cell form 21, it is preferable that the distance between the tip of the suction nozzle 42 and the upper surface of the cell form 21 be set to be not more than 2 mm. There is a case where the distance is desirable to be not more than 1 mm depending on a pattern to be expressed. This small distance can reduce the amount of air sucked from the periphery to the inside of the suction nozzle 42. In addition thereto, since the pre-filling particles have a particle size of not more than 600 $\mu$m and exhibit high fluidity, those only at a prescribed number of cells of the cell form 21 can be rapidly removed with exactitude. Thereafter, by operating the scanner 31 while continuing and stopping the operation of the particle-supplying device 51, first shaped article-forming particles 11 consisting of brown particles admixed with hard, gray particles pulverized into relatively large size of 1 to 1.5 mm are supplied, as shown in FIG. 4(*c*), through the supply nozzle 52 into the cells from which the pre-filling particles have been removed.

The pre-filling particles 10 existing in the cells corresponding to the peak of Mt. Fuji are then removed as shown in FIG. 4(*d*) by operating the scanner 31 while continuing and stopping the operation of the suction device 41. By operating the scanner 31 while continuing and stopping the operation of the particle-supplying device 51, second shaped article-forming particles 12 consisting of white particles admixed with hard, relatively large, gray particles of 1 to 1.5 mm are filled, as shown in FIG. 4(*e*), in the cells from which the pre-filling particles have been removed.

The pre-filling particles 10 existing in the cells corresponding to the sky around Mt. Fuji are then removed as shown in FIG. 4(*f*) by operating the scanner 31 while continuing and stopping the operation of the suction device 41. By operating the scanner 31 while continuing and stopping the operation of the particle-supplying device 51, third shaped article-forming particles 13 consisting of blue particles admixed with hard, gray particles pulverized into relatively large size of 1 to 1.5 mm are filled, as shown in FIG. 4(*g*), in the cells from which the pre-filling particles have been removed.

After completion of the substitution of the first to third shaped article-forming materials 11 to 13 for the pre-filling materials 10, the retainer 21 is removed as shown in FIG. 4(*h*) to release the shaped article-forming materials onto the base surface 62, whereafter the backing layer 3 is overlaid on the released materials as shown in FIG. 4(*i*), and the whole is caused to set by pressure or the like means into an integral mass. A perspective view of FIG. 4(*h*) showing the state in which the retainer 21 has been removed corresponds to FIG. 5, and that of FIG. 4(*i*) showing the state in which the backing layer 3 has been overlaid on the shaped article-forming materials corresponds to FIG. 6.

The first embodiment will be described in more detail. The pre-filling particles 10 have a particle size of not more than 600 $\mu$m. The retainer 21 is provided with a plurality of hexagonal cells densely arranged in a continuous manner and each having a side of 1.5 mm and a height of 20 mm. The distance between the retainer 21 and the suction nozzle 42 of the suction device 41 is set to be 700 $\mu$m. The suction nozzle 42 is set in position on the scanner 31 so that it can be scanned at an optional speed.

According to the first embodiment of the invention, since the pre-filling particles 10 have a particle size of not more than 600 $\mu$m, as described above, they can be removed by suction at a speed twice to thrice that at which particles having a particle size of more than 600 $\mu$m are removed by suction and, during the supply and removal of the pre-filling particles not more than 600 $\mu$m in particle size, it is possible to eliminate or diminish the risks of damaging the retainer 21 and wearing the suction nozzle 42 that would be involved where hard particles or large particles having a particle size of more than 600 $\mu$m are supplied and removed at high speeds.

The smaller the particle size of the pre-filling particles 10, the smaller the distance between the retainer 21 and the suction nozzle 42. This makes it possible to remove the pre-filling particles 10 infallibly from the particle-retaining spaces and to form a beautiful shaped article 1.

When the suction nozzle 42 is used to remove the pre-filling particles 10, the diameter of the pre-filling particles 10 is set to be smaller than the distance between the retainer 21 and the suction nozzle 42. This prevents the pre-filling particles 10 from being clamped between the retainer 21 and the suction nozzle 42, resulting in avoiding failure to suck up the pre-filling particles 10 and enhancing the productivity of patterned shaped articles.

The diameter of the pre-filling particles 10 is determined in consideration of the gap between the retainer 21 and the suction nozzle 42 and is preferably such that the particles can loosely pass through the gap.

The pre-filling particles 10 are not restricted on their surface features, but are preferably dry and exhibit high fluidity so that they can efficiently removed. When containing various additives including surfactants, electrical charge-preventing agents, flame-retarding agents and flame-preventing agents, the pre-filling particles 10 are modified into preferable particles that are dry, easy to separate, and difficult to burn.

In the first embodiment, the retainer 21 used is a cell form having a plurality of cells densely arranged in a contiguous manner. A retainer 22 that is a projection bristling form comprising a support sheet 23 and a plurality of projections 24 bristling from the support sheet 23 as shown in FIG. 7 can be used instead. In addition, the suction device 4 is used as means for removing the pre-filling particles 10. However, this is by no means limitative. For example, an air blower (not shown in this embodiment) can be used instead or in combination with the suction device 4.

Figure 8:
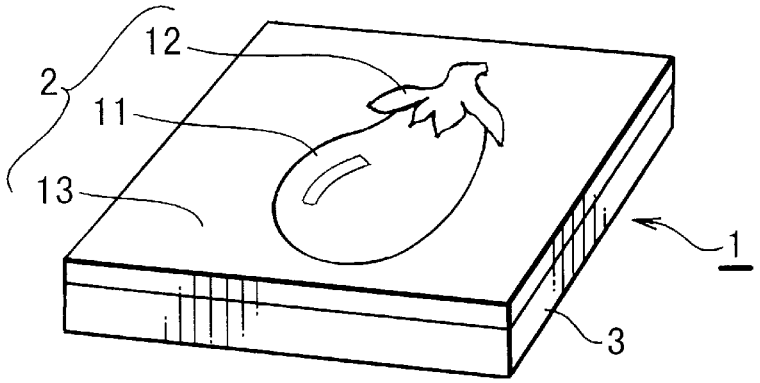
FIG. 8 is a perspective view showing a patterned shaped article obtained by a second embodiment of the patterned shaped article producing method according to the present invention.

A patterned shaped article 1 shown in FIG. 8 is produced by a second embodiment of the method of the invention. As in the first embodiment, the article 1 of this embodiment comprises a pattern course 2 and a backing layer 3 provided on the lower side (back surface) of the pattern course 2. However, the pattern course 2 expresses an eggplant pattern.

The patterned shaped article 1 is produced using the retainer 21 (cell form) shown in FIG. 2 and carrying out the steps shown in FIGS. 4(*a*) to 4(*i*).

Specifically, pre-filling particles 10 are first filled in the particle-retaining spaces (cells) of the retainer 21 disposed on the base surface 62 of the support plate 61 as shown in FIG. 4(*a*). The pre-filling particles 10 existing in the cells corresponding to the egg apple of the eggplant are then removed as shown in FIG. 4(*b*) by operating the scanner 31 while continuing and stopping the operation of the suction device 41. By operating the scanner 31 while continuing and stopping the operation of a particle-supplying device 51, first shaped article-forming particles 11 consisting of uniform, purple particles are filled, as shown in FIG. 4(*c*), in the cells from which the pre-filling particles 10 have been removed.

The pre-filling particles 10 existing in the cells corresponding to the calyx of the eggplant are then removed as shown in FIG. 4(*d*) by operating the scanner 31 while continuing and stopping the operation of the suction device 41. By operating the scanner 31 while continuing and stopping the operation of the particle-supplying device 51, second shaped article-forming particles 12 consisting of uniform, green particles are filled, as shown in FIG. 4(*e*), in the cells from which the pre-filling particles 10 have been removed.

The pre-filling particles 10 existing in the cells corresponding to the background of the eggplant are then removed as shown in FIG. 4(*f*) by operating the scanner 31 while continuing and stopping the operation of the suction device 41. By operating the scanner 31 while continuing and stopping the operation of the particle-supplying device 51, third shaped article-forming particles 13 consisting of uniform, white particles are filled, as shown in FIG. 4(*g*), in the cells from which the pre-filling particles 10 have been removed.

After completion of the substitution of the first to third shaped article-forming materials 11 to 13 for the pre-filling materials 10, the retainer 21 is removed as shown in FIG. 4(*h*) to release the shaped article-forming materials onto the base surface 62, whereafter the backing layer 3 is overlaid on the released materials as shown in FIG. 4(*i*), and the whole is caused to set by pressure or the like means into an integral mass.

The second embodiment will be described in more detail. The pre-filling particles 10 have a particle size of not more than 100 μm. The retainer 21 is provided with a plurality of hexagonal cells densely arranged in a continuous manner and each having a side of 1.5 mm and a height of 10 mm. The distance between the retainer 21 and the suction nozzle 42 of the suction device 41 is set to be 200 μm.

According to the second embodiment of the invention, since the pre-filling particles 10 have a particle size of not more than 100 μm, as described above, they can be removed by suction at a speed twice to thrice that at which particles having a particle size of more than 100 μm are removed by suction. Since the first to third shaped article-forming particles 11 to 13 are uniform and have a particle size of not more than 1 mm, they can be filled at high speeds.

Figure 9:
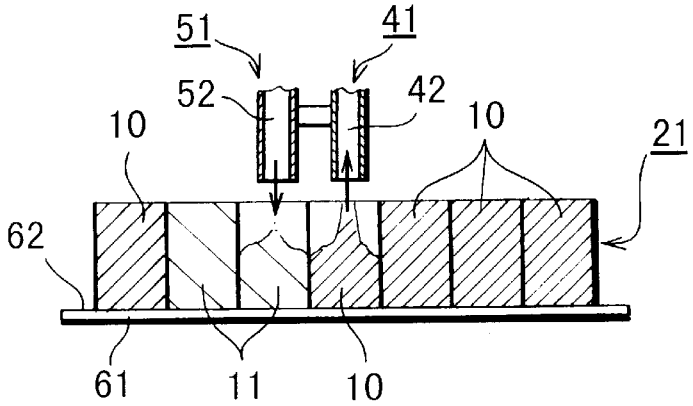
FIG. 9 is an explanatory view showing the nozzle of the suction device and the nozzle of one example of a supply device used in the method.

As shown in FIG. 9, as soon as the pre-filling particles 10 are removed at high speeds using the suction nozzle 42 of the suction device 41, the shaped article-forming particles 11 to 13 can be filled at high speed using the supply nozzle 52 of the particle-supplying device 51.

Furthermore, since the particle size of the pre-filling particles 10 is set to be not more than 100 μm, the distance between the retainer 21 and the suction nozzle 42 can be made small up to 200 μm. This makes it possible to remove the pre-filling particles 10 infallibly from the particle-retaining spaces and to form a beautiful shaped article 1.

When the suction nozzle 42 is used to remove the pre-filling particles 10, the diameter of the pre-filling particles 10 is set to be smaller than the distance between the retainer 21 and the suction nozzle 42. This prevents the pre-filling particles 10 from being clamped between the retainer 21 and the suction nozzle 42, resulting in avoiding failure to suck up the pre-filling particles 10 and enhancing the productivity of patterned shaped articles.

Furthermore, the particle diameter of the pre-filling particles 10 is small, i.e. not more than 100 μm, the diameter of the suction nozzle 42 can be made smaller than that used in the first embodiment. This enables removal of the pre-filling particles 10 from every nook and corner of the cells, resulting in a clear-cut pattern of a shaped article.

The diameter of the pre-filling particles 10 is determined in consideration of the gap between the retainer 21 and the suction nozzle 42, and it is preferable that the particles can loosely pass through the gap.

The pre-filling particles 10 are not restricted on their surface features, but are preferably dry and exhibit high fluidity so that they can efficiently be removed. When containing various additives including surfactants, electrical charge-preventing agents, flame-retarding agents and flame-preventing agents, the pre-filling particles 10 are modified into preferable particles that are dry, easy to separate and difficult to burn.

Figure 10:
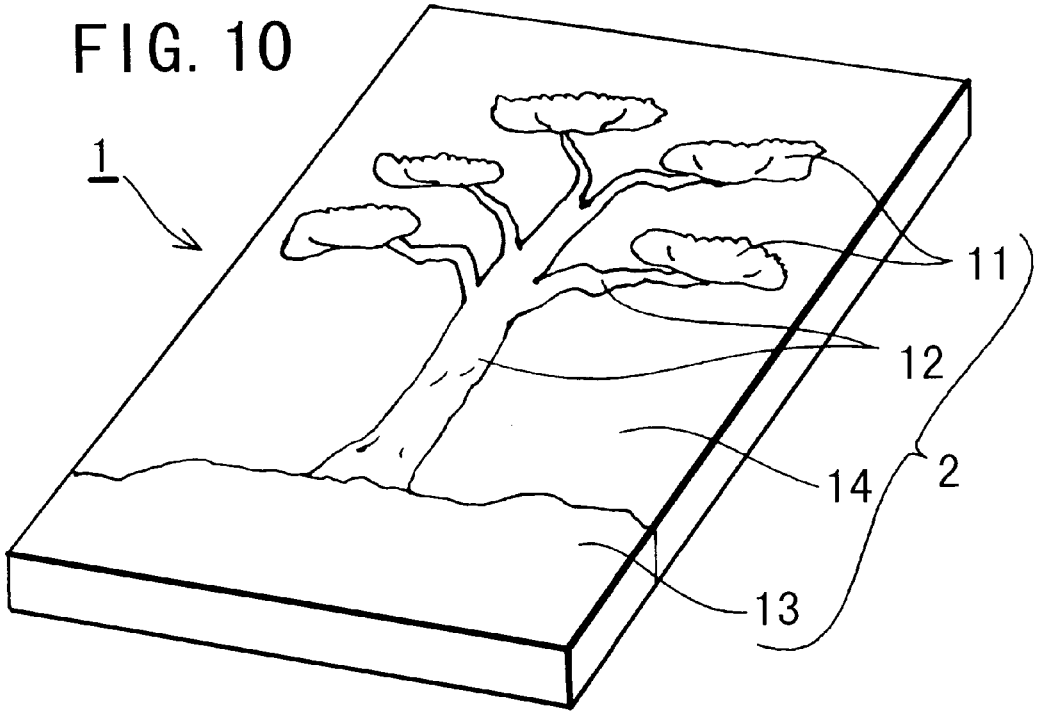
FIG. 10 is a perspective view showing a patterned shaped article obtained by a third embodiment of the patterned shaped article producing method according to the present invention.

A shaped article 1 comprising a pattern course 2 with a tree pattern as shown in FIG. 10 is produced by a third embodiment of the method of the invention using the retainer 21 and particle-supplying device 51 shown in FIG. 3, a scanner 31 attaching thereto an air blower 45 equipped with a blow nozzle 46 in place of the suction device 41 equipped with the suction nozzle 42 shown in FIG. 3, and control means (not shown) for controlling the amount of air to be blown via the blow nozzle 46 and the operation of the air blower 45.

To be specific, pre-filling particles 10 are filled in all the particle-retaining spaces (cells) of the retainer 21 (cell form) disposed on the base surface 62 of the support plate 61.

Figure 11:
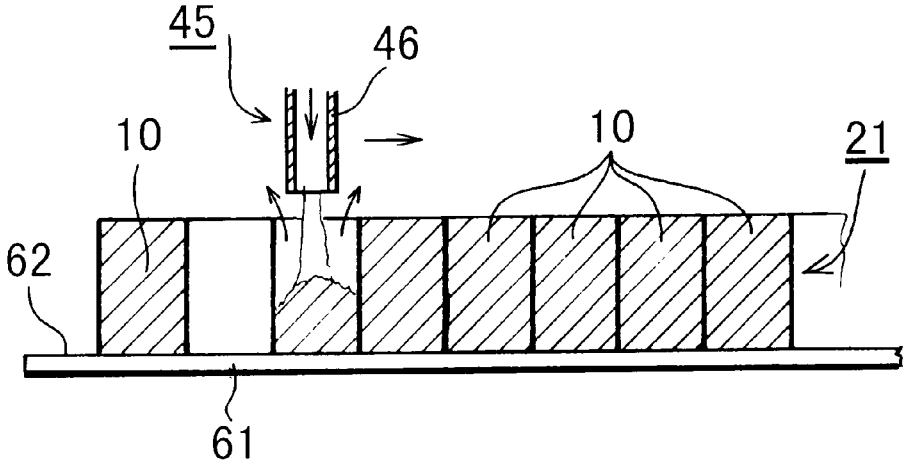
FIG. 11 is an explanatory view showing the nozzle of one example of an air blower used in the method.

The pre-filling particles 10 existing in the cells corresponding to the leaves of the tree are then removed as shown in FIG. 11 by operating the scanner 31 while continuing and stopping the operation of the air blower 45. By operating the scanner 31 while continuing and stopping the operation of the particle-supplying device 51, first shaped article-forming particles 12 consisting of highly adhesive, green particles are filled in the cells from which the pre-filling particles 10 have been removed.

The pre-filling particles 10 existing in the cells corresponding to the trunk and branches of the tree are then removed by operating the scanner 31 while continuing and stopping the operation of the air blower 45. By operating the scanner 31 while continuing and stopping the operation of the particle-supplying device 51, second shaped article-forming particles 12 consisting of highly adhesive, brown particles are filled in the cells from which the pre-filling particles 10 have been removed.

The pre-filling particles 10 existing in the cells corresponding to earth under the tree are then removed by operating the scanner 31 while continuing and stopping the operation of the air blower 45. By operating the scanner 31 while continuing and stopping the operation of the particle-supplying device 51, third shaped article-forming particles 13 consisting of highly adhesive, sallow particles are filled in the cells from which the pre-filling particles 10 have been removed.

The pre-filling particles 10 existing in the cells corresponding to the background of the tree are then removed by operating the scanner 31 while continuing and stopping the operation of the air blower 45. By operating the scanner 31 while continuing and stopping the operation of the particle-supplying device 51, fourth shaped article-forming particles 14 consisting of highly adhesive, white particles are filled in the cells from which the pre-filling particles 10 have been removed.

After completion of the substitution of the first to fourth shaped article-forming particles 11 to 14 for the pre-filling materials 10, the retainer 21 is removed to release the shaped article-forming particles onto the base source 62, whereafter the whole is caused to set by pressure or the like means into an integral mass.

The third embodiment will be described in more detail. The pre-filling particles 10 have a particle size of not more than 100 $\mu$m. The cells of the retainer 21 are hexagonal an have a side of 1.5 mm and a height of 20 mm. The distance between the retainer 21 an the blow nozzle 46 of the air blower 45 is set to be 200 $\mu$m.

In the third embodiment of the invention, the same effects as in the first and second embodiments can be obtained. Since in the third embodiment the particle size of the pre-filling particles 10 is set to be not more than 100 $\mu$m and since the distance between the retainer 21 and the blow nozzle 46 is set to be 200 $\mu$m, air around the periphery of the blow nozzle 46 is suppressed from being blown into adjacent particle-retaining spaces. This makes it possible to remove by blowing the pre-filling particles 10 infallibly away from the particle-retaining spaces at high speed about three times that required for removing highly adhesive or large particles.

Figure 12:
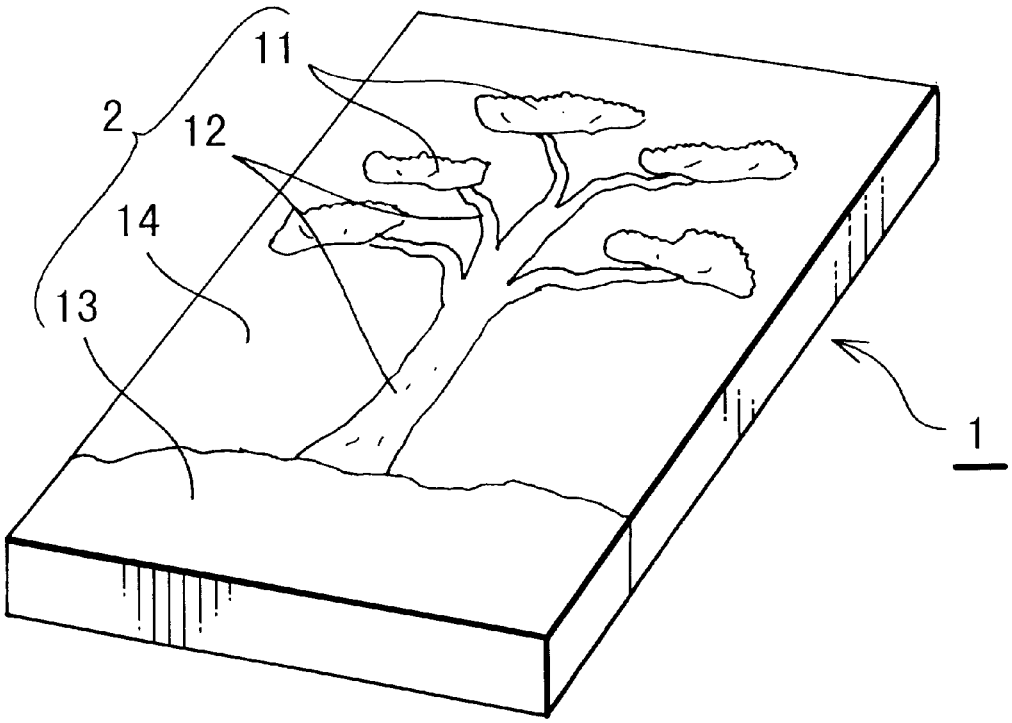
FIG. 12 is a perspective view showing a patterned shaped article obtained by a fourth embodiment of the patterned shaped article producing method according to the present invention.
Figure 13:
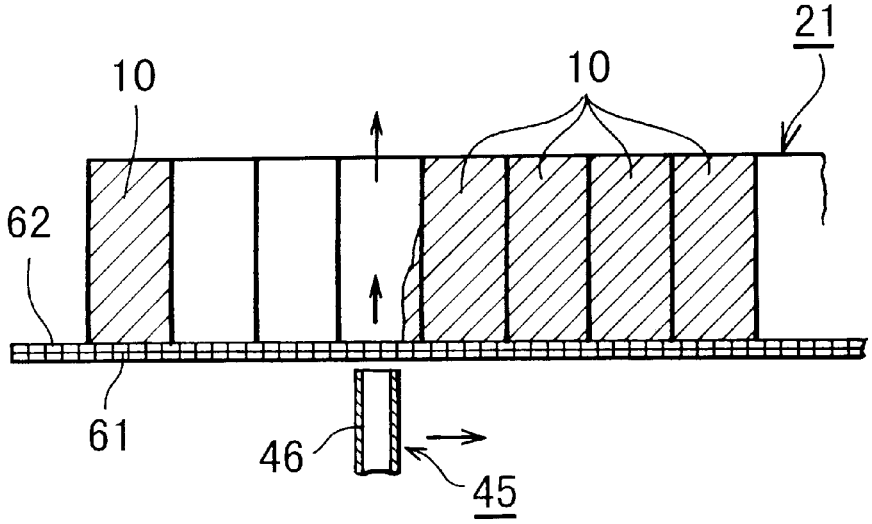
FIG. 13 is an explanatory view showing the nozzle of another example of the air blower used in the method.

A shaped article shown in FIG. 12 comprises a pattern course 2 with a tree pattern similar to that shown in FIG. 10 and is produced by a fourth embodiment of the method of the invention in the same manner as in the third embodiment. The difference between the third embodiment and the fourth embodiment is that the fourth embodiment uses first to fourth shaped article-forming particles 11 to 14 containing large particles of 5 to 7 mm, a retainer 21 with a ventilative bottom and a plurality of densely arranged square cells having a side of 10 mm and a height of 30 mm, and an air blower 45 having a blow nozzle 46 disposed below the retainer 21 as shown in FIG. 13.

The pre-filling particles usable in any of these embodiments include dry particles of foodstuffs, stone, coal, bones, shells, soil, clay, glass, ceramic, metal, plastic, compounds, chemicals, fibers, and skins; ash; powdered paint, cement powder; wood chips; paper scraps; and the like. In order to avoid that the pre-filling particles remain as an extraneous substance in the course of manufacturing a patterned shaped article, the pre-filling particles are preferably of materials that can be burnt down in subsequent steps including a firing step or that are the same in kind or quality as the materials for the patterned shaped article to be formed.

The diameter of the pre-filling particles is preferably less than the distance between the retainer and the suction or blow nozzle because this can prevent the pre-filling particles from being clamped between the retainer and the suction or blow nozzle when the suction or blow nozzle is moved at high speed to remove the pre-filling particles and avoid failure to suck up or blow the pre-filling particles away, to attain high productivity.

The diameter of the pre-filling particles is determined in accordance with the distance between the retainer and the suction or blow nozzle and is preferably a size capable of loosely pass through the distance. While the pre-filling particles not larger than 600 $\mu$m in diameter are easy to remove, the pre-filling particles can be removed at higher speed if the diameter thereof is not more than 300 $\mu$m. The distance between the retainer and the suction or blow nozzle can be made shorter with decreasing diameter of the pre-filling particles. Therefore, the diameter of the pre-filling particles is preferably not more than 100 $\mu$m. The smaller the diameter of the pre-filling particles, the smaller the diameter of the suction or blow nozzle. The suction or blow nozzle having a smaller diameter enables a minute pattern to be expressed. Use of pre-filling particles of smaller size enables the distance between the retainer and the nozzle to be substantially zero from the mechanical point of view and can prevent an air flow from the periphery of the nozzle. A shorter distance between the retainer and the suction or blow nozzle facilitates infallible removal of the pre-filling particles from the particle-retaining spaces, resulting in beautiful finish of a shaped article. Preferably, the pre-filling particles are dry and exhibit high fluidity because efficient removal can be attained. Further, the pre-filling particles if modified by including various additives such as surfactants, electric charge-preventing agents, flame-retarding agents and flame-preventing agents, are dry, easy to separate, and difficult to burn. This can eliminate or diminish the risks of damaging the retainer and wearing the particle-removing means that would be involved where the pre-filling particles are supplied an removed and the shaped article-forming particles are supplied at high speeds.

Figure 14:
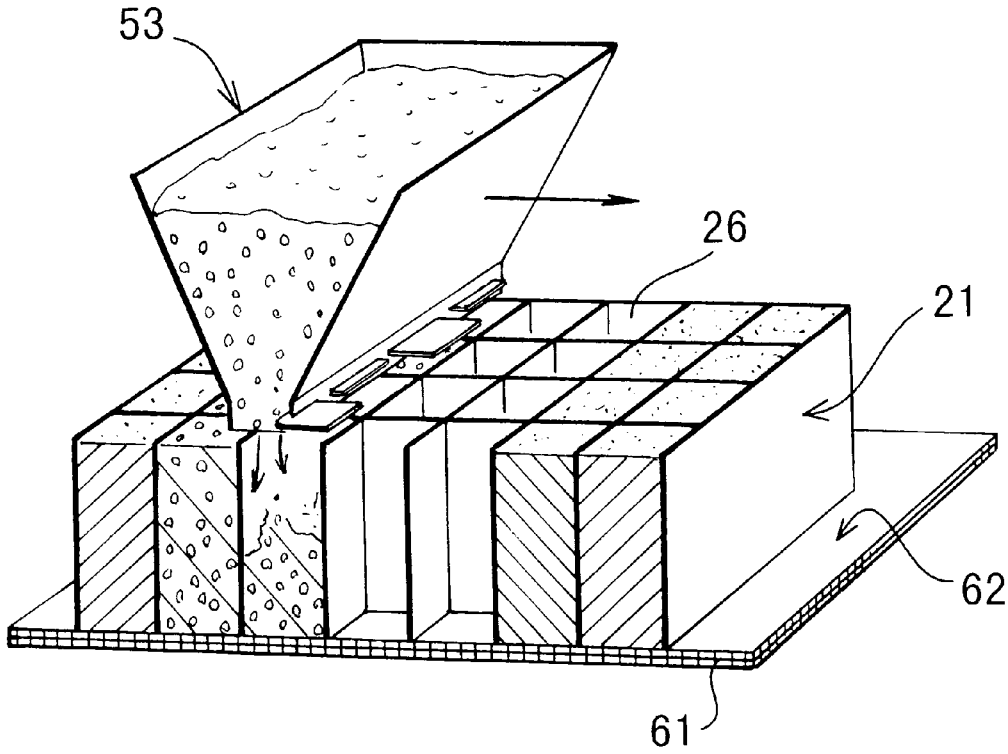
FIG. 14 is an explanatory view showing another example of the supply device used in the method.

The shaped article-forming particles can be supplied into the empty spaces of the retainer formed by removing the pre-filling particles using the supply nozzle 52 shown in FIG. 9, a hopper 53 of FIG. 14 having a plurality of supply ports that can be controlled in opening and closing operation whenever reaching each line or row of spaces of the retainer, a bottle (not shown), or any other such means.

When the shaped article-forming particles have a uniform diameter, these exhibit high fluidity. For this reason, the uniform shaped article-forming particles are advantageous when it is desired to rapidly supply these into the vacant spaces formed after the pre-filling particles are removed from the retainer. Shaped article-forming particles of not more than 2 mm obtained by the use of various pulverizing means such as a spray dryer exhibit high fluidity and are desirable because these are advantageously applicable to small cells of a cell form retainer or small spaces between projections of a projection-bristling form retainer.

As the retainer, any other form can be used solely or in combination with the cell form and/or the projection-bristling form.

The cross-sectional shape of the cells can be a circle, a polygon including a triangle, square and hexagon, or any other shape. While the partition walls defining the cells of the cell form shown in FIG. 2 are continuous, these may be discontinuous or have cuts if a pattern can be expressed. In this case, the cell form becomes a flexible retainer.

The projections of the projection-bristling form may be in any of various forms such as pins, pieces, pile or loops formed by knitting or weaving, pipes, standing fibers that can be of the implanted, raised or attached type, etc.

Figure 15:
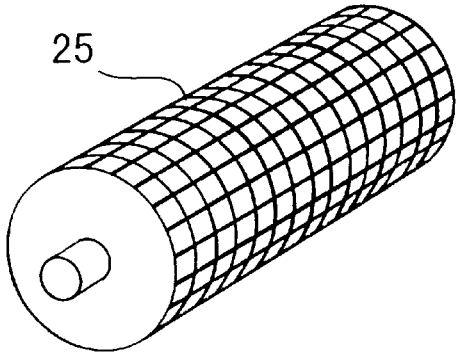
FIG. 15 is a perspective view showing still another example of the retainer used in the method.

While the cell form shown in FIG. 2 is of a flat type, it may be a rotary drum 25 as shown in FIG. 15. The rotary drum is provided with a plurality of circumferential cells in the form of a matrix.

Figure 16:
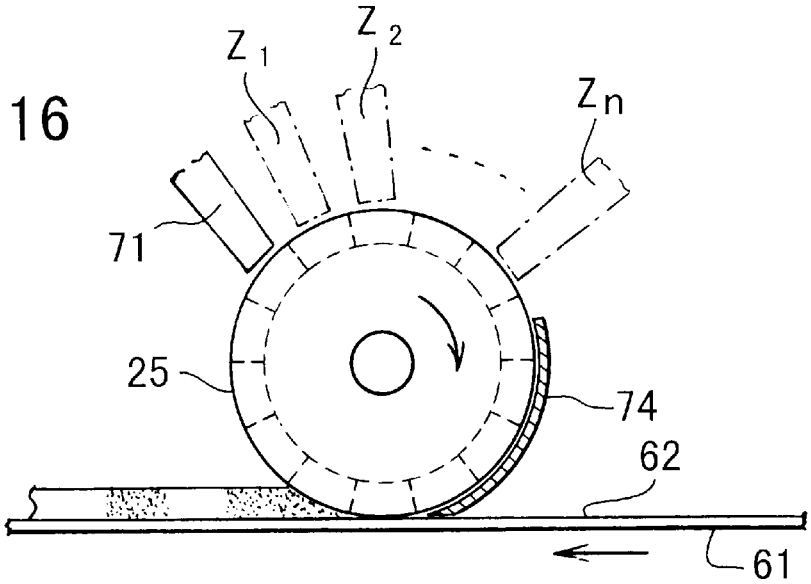
FIG. 16 is an explanatory view showing how to use the retainer of FIG. 15.
Figure 17:
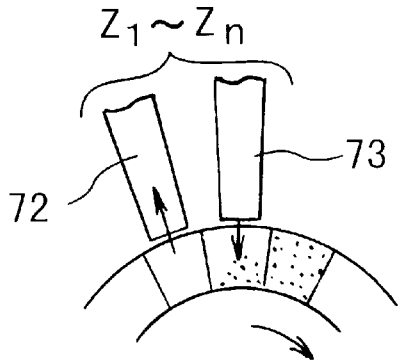
FIG. 17 is an explanatory view showing the steps of removing the pre-filling particles from and supplying shaped article-forming particles into the retainer of FIG. 15 taken at each of n zones.

In the case where patterned shaped articles are produced using this rotary drum 25, n zones $Z_1$ to $Z_n$ are successively provided on the downstream side of a hopper 71 for supplying pre-filling particles and a retaining plate 74 for preventing shaped article-forming particles from falling off the cells is provided 1on the downstream side of the nth zone $Z_n$. The hopper 71 and retaining plate 74 are shown in FIG. 16. At each of the zones $Z_1$ to $Z_n$ a particle-removing nozzle 72 is provided along the axis of the rotary drum 25 to remove the pre-filling particles from facing cells and a shaped article-forming particle-supplying hopper 73 is provided so that corresponding colored shaped article-forming particles can be supplied into facing cells.

In this embodiment, the pre-filling particles are supplied into each cell of the rotary drum 25 using the pre-filling particle-supplying hopper 71 while rotating the rotary drum 25 in the direction indicated by one of the arrows in FIG. 16. Then, the particle-removing nozzle 72 and particle-supplying hopper 73 are used to carry out the steps of removing the supplied pre-filling particles from and supplying shaped article-forming particles of n different colors into the corresponding cells of the rotary drum 25 at each of the n zones $Z_1$ to $Z_n$. Upon completion of the steps, the support plate 61 is caused to run in the direction indicated by the other of the arrows in FIG. 16 at the same speed as the peripheral speed of the rotary drum 25 to release the shaped article-forming particles onto the base surface 62 of the support plate 61. Shaped articles can thus be produced using the rotary drum 25 that is an endless cell form. It goes without saying that the projection-bristling form 22 shown in FIG. 7 may be made endless.

The size of the spaces of the retainer for retaining the particles therein is set to be not more than 10 mm. In order to express a clear-cut pattern, the smaller, the better. The height of the retainer is determined in view of the thickness of a shaped article to be formed. Although the number of the cells or projections shown in FIG. 2 or FIG. 7 is small for convenience of illustration, the number is not limitative. In the case of the cells with a side of 1 to 2 mm, actually used in the first to third embodiments described above, the number of the cells is in the range of from several hundred thousands to several millions per shaped article, resulting in expression of a clear-cut pattern.

The retainer can be made from metal, ceramic, plastic, rubber, paper, nonwoven fabric, woven fabric, knit fabric, etc. It is preferable that the support plate is made from a material capable of allowing close adhesion of the retainer to the base surface of the support plate because this enables a clear-cut pattern to be expressed.

By forming the support plate of nonwoven fabric, woven fabric, knit fabric, paper or the like material to afford air or liquid permeability and liquid absorbency to the base surface, degassing can be enhanced and any excess amount of liquid can be absorbed, with the result that the strength of a shaped article to be produced can be kept uniform. This also functions to prevent the particles from being displaced by friction when removing the retainer.

In the embodiment shown in FIG. 13 for removing the pre-filling particles using the air blower, if the retainer has a bottom plate (not shown), the bottom plate is preferably made air-permeable. The air-permeable substances usable in this case include nonwoven fabric, woven fabric, knit fabric, or a meshed member of or a bored or porous sheet or plate of metal, fiber, plastic, ceramic, rubber or the like of these substances, nonwoven fabric is preferably used because it is inexpensive and easy to handle. The bottom plate may either be integral with the retainer or be a separate member attached to the retainer.

The surface of a frame bottom plate, board, sheet, belt, plate, double acting cylinder bottom plate, setter bottom plate, endless belt conveyor, etc. can be used as the base surface. The bottom plate of a frame disposed on a conveyor can also be used as the base surface. A layer of particles is deposited, either directly or after being turned upside down, on the surface of a board, sheet, etc.

If a slightly bulky and elastic base surface of rubber, sponge, paper, nonwoven fabric, etc. is used, there is produced a play between the base surface and the retainer when the retainer is abutted against the base surface. This facilitates the step of positioning the retainer in the direction of the retainer height. Since in addition thereto the retainer is securely partitioned by the cell walls or bristling projections, sharp lines can be expressed.

A support member (not shown) for the retainer, provided on a part or the whole thereof with resilient or elastic means such as a spring or rubber member, can be used to cause the retainer to abut against the base surface. Otherwise, an elastic member such as yarn or string may be attached to the surface of the retainer to abut against the base surface.

The removal of the pre-filling particles can be attained by one or both of suction and blowing. Since the pre-filling particles having a small particle size are used, these can be removed even when the diameter of the suction or blow nozzle is small. This enables an eventual pattern to be clear-cut. In this case, it suffices that the diameter of the suction nozzle is not more than 5 mm and that of blow nozzle is not more than 3 mm. If an eventual pattern is desired to be more clear-cut, however, the diameter of the suction nozzle is preferably not more than 2.5 mm and that of the blow nozzle not more than 1.5 mm. Although a single blow or suction nozzle or a pair of blow and suction nozzles can be used, a plurality of blow nozzles and/or suction nozzles may be used in a line, matrix or slitted form.

It is preferable to give vibration to the retainer when filled with the shaped article-forming particles. This enables every nook and corner of the retainer spaces to be fully filled with shaped article-forming particles, whereafter the cave-in action of the particles is promoted in removing the retainer to produce a dense article.

While a shaped article of predetermined size can be produced one by one, a large-sized article can be produced and cut into individual ones having the predetermined size after being set. It is optional how a patter is to be expressed. Various patterns can be expressed using any one or combination of the embodiments described so far or other methods and apparatus falling within the scope of the invention. It can be selected depending on the shaped article-forming particles used whether an article is to be formed preliminarily or really, with or without addition of one or more of water, oil, solvent, lubricant-bonding agent, plasticizer, setting agent, etc. by means of pressing, heating or sintering or by combined means.

In producing a patterned shaped article according to the invention, although shaped article-forming material is dry, it may have absorbed some moisture if it is not kneaded with water, oil, lubricant-bonding agent, solvent, setting agent or plasticizer and is in a state readily amenable to pulverization before supplying. On the other hand, the material of which the backing layer is formed may either be dry or wet with one or more of water, oil, lubricant-bonding agent, solvent, setting agent and plasticizer. Otherwise, a plate of metal, wood, cement, glass or ceramic or a sheet of paper, nonwoven fabric, woven fabric, knit fabric or plastic may be used as the backing layer. In this case, the plate or sheet serves as the base surface. Any other existing shaped article may be used as the base surface.

The shaped article-forming particles to be supplied may differ in material from one another depending on the shaped article to be produced. Otherwise, in the finished state they are required to differ from one another in color, luster, texture and the like.

In producing a concrete shaped article, the shaped article-producing particles are dry and are cement powder, resin or a mixture thereof and may additionally include at least one of a pigment and fine aggregates.

Examples of the material for the backing layer include cement powder, resin, a mixture of cement powder and resin, the mixture further containing a fine aggregate and, if necessary, additionally containing a pigment and at least one of coarse aggregates and various kinds of fibers. The backing layer material may either be the same material as the shaped article-forming particles or be in the form of a concrete slurry obtained by kneading with water etc.

Both the materials for the shaped article-forming particles and the material for the backing layer may additionally include wood chips as aggregates or fine aggregates and may further include as blended therewith crushed or pulverized granite, crushed or pulverized marble, slag, light-reflecting particles, inorganic hollow bodies such as Shirasu balloons, particles of ceramics, new ceramics, metal, ore or other such substances. They may also contain as additives a congealing and curing promoter, a waterproofing agent, an inflating agent and the like. The aforementioned various kinds of usable fibers include metal fibers, carbon fibers, synthetic fibers, glass fibers and the like.

All the materials are supplied into a frame etc. and are allowed to set into an integral mass. Otherwise, after the material supplying, water is supplied in a suitable amount to all portions of the interior of the frame etc., thereby setting the materials into an integral mass within the frame etc. If a wet material is used for the backing layer, the amount of water supplied is reduced in view of the water contained in the wet material. When a plate of metal, wood, cement, glass or ceramic or a sheet of paper, nonwoven fabric, woven fabric or knit fabric is used as the backing layer, for example, it is set integral with the pattern course. An asphaltic concrete shaped article can be produced using a thermal fusion material such as asphalt etc.

In producing an artificial stone shaped article, the dry materials for the pattern course and the materials for the backing layer may, for example, be constituted preponderantly of one or more of rock particles, ceramic particles, new ceramic particles, glass particles, plastic particles, wood chips and metal particles and may, as found necessary, further have mixed therewith a pigment etc. The materials for the backing layer is either dry or wet. Examples of the wet materials include materials containing a setting agent for bonding the mixture. The setting agent filled in the gaps formed between the adjacent dry materials for the pattern course or contained in the materials for the backing layer is a mixture of cement powder and water, a mixture of cement powder, resin and water, or a mixture of resin, water and a solvent and may further contain particles of one or more of rock, ceramic, new ceramic, glass and plastic and may, as found necessary, be kneaded with a pigment or colorant and have mixed therewith various kinds of particles, various kinds, of fibers, various kinds of mixing agents and various kinds of additives. The various kinds of particles include particles of slag, fly ash and light-reflecting substances. The various kinds of fibers include metal fibers, carbon fibers, synthetic fibers and glass fibers. The various kinds of mixing agents and additives include shrink proofing agents, congealing and setting agents, delaying agents, waterproofing agents, inflating agents, water reducing agents, fluidizing agents and the like.

If necessary for enhancing the adherence of the setting agent and with the aforementioned dry materials, the materials can be sprayed with or immersed in water, solvent or surface treatment agent. However, they are not kneaded with such moisture and are in a state readily amenable to pulverization.

All the materials can be set into an integral mass within a frame etc. by vacuum-suction treatment, centrifugal force or other such treatment or means for spreading the setting agent between adjacent particles or by using a mixture of aggregates and a setting agent as the material for the backing layer. When a plate of metal, wood, cement, glass or ceramic, or a sheet of paper, nonwoven fabric, woven fabric, knit fabric or plastic is used as the backing layer, the pattern course is attached as superposed on the backing layer.

For producing a ceramic shaped article or the raw product for a ceramic shaped article, the dry materials for the pattern course are particles of one or more of clay, rock, glass, new ceramic, fine ceramic and glaze with or without a pigment or colorant added thereto. The materials may be ones which have absorbed some water or been added with a lubricant-bonding agent after drying, but they are not kneaded with the lubricant-bonding agent or water and are in a state readily amenable to pulverization. The material for the backing layer is constituted of particles of one or more of clay, rock, glass, new ceramic and fine ceramic and may additionally contain a pigment and a colorant. The material for the backing layer may be either dry, similarly to the pattern course, or made wet by kneading with water or a lubricant-bonding agent. In addition, either the materials for the pattern course or the material for the backing layer may have further mixed therewith inorganic hollow bodies such as Shirasu balloons, and particles of ceramic, metal or ore, and may have added thereto various kinds of foaming agents, fluidization-preventing agents, supernatant agents, lubricating agents, bonding agents, adherence promoters and other such additives.

All the materials supplied into a frame etc. are allowed or caused to set into an integral mass without adding, or by adding, a predetermined amount of water or lubricant-bonding agent to plasticize them and applying pressure to the resultant mixture. The set integral mass is removed from the frame etc. and used as a raw product. The raw product is sintered to obtain a ceramic shaped article. Otherwise, the materials supplied into a refractory setter or the like frame are melted or fused by heating to obtain an integral mass, and the integral mass is removed from the setter. In the case of a patterned shaped article of enamel, stained glass or crystalline glass, the materials for the pattern course are laid in the form of a layer on a plate of metal, glass or ceramic and melted or fused by heating to be made integral with the plate.

The dry materials for producing a raw product for a patterned shaped metal article are particles of one or more of various metals and alloys with or without a lubricant added thereto. The materials may be ones which have been added with a lubricant after drying, but they are not kneaded with the lubricant and are in a state readily amenable to pulverization. The materials for a backing layer are particles of one or more of various metals and alloys with or without a lubricant added thereto and may either be dry or made wet by kneading with a lubricant. Examples of the lubricant used include zinc stearate etc. In addition, either the dry materials or the materials for the backing layer may have further mixed therewith a binder and other additives. The materials supplied into a frame etc. are exposed to pressure to set into an integral mass. The set integral mass is removed from the frame etc. and used as a raw product. The raw product is sintered to obtain a patterned shaped metal article. Otherwise, the materials are supplied in the form of a layer onto a plate of metal, glass, ceramic, etc. and pressure is applied to the materials and plate to obtain an integral mass. The integral mass is then sintered.

The dry materials for the pattern course used in producing a shaped article having an impasto layer are various kinds of powdered paint, and the material for the backing layer is a plate or the like of metal, wood, cement or ceramic. The various kinds of powdered paint include acrylic resin, polyester resin, acrylic-polyester hybrid resin, fluorine resin and similar resins having a pigment or colorant added thereto. The materials for the pattern course are laid on the plate as a backing layer and melted and fused by heating to unit the two layers together. In uniting the two layers together, pressure may be applied to the layers. As a result, it is possible to obtain a plate having an impasto layer thereon.

In producing a plastic shaped article, the dry materials for the pattern course are constituted of particles of various kinds of plastics and may additionally contain a pigment or colorant. The materials may also contain a plasticizer or solvent, but are not kneaded with a plasticizer or solvent and are in a state readily amenable to pulverization. The material for the backing layer may either be one of the dry materials mentioned above or be made wet by kneading with a plasticizer or solvent. The various kinds of plastics include polyethylene, nylon, polypropylene, polycarbonate, acetal, polystyrene, epoxy, vinyl chloride, natural rubber, synthetic rubber, acrylonitrile-butadiene-styrene, polypropylene resin, ethylene-vinyl acetate copolymer, fluorine resin and other thermoplastic and thermo-setting resins. Both the materials for the pattern course and the material for the backing layer may, as found necessary, contain a foaming agent, oxidation preventing agent, thermal stabilizer, bridging agent, other additives and particles of inorganic materials.

All the materials are melted or fused into an integral mass by heating, while applying pressure thereto, if necessary. With this method, it is possible to produce a patterned shaped article of foamed styrol, patterned shaped bathtub or floor tile of plastic, etc. In this case, the two layers may be united with a plate of metal, wood, cement, ceramic, etc., or a sheet of paper, nonwoven fabric, woven fabric, knit fabric, plastic, etc.

In producing confectionery or other shaped foodstuffs, the dry materials for the pattern course are constituted of particles of one or more of wheat, rice, potato, bean, sugar and corn and may additionally containing seasonings and spices. The materials may also contain oil or water, but are not kneaded with oil or water and are in a state readily amenable to pulverization. The material for the backing layer may either be one of the dry materials mentioned above or be made wet by kneading with oil or water. Both the materials for the pattern course and the material for the backing layer may, as found necessary, further contain an inflating agent and other additives.

All the materials supplied into a frame etc. are allowed or caused to set by adding a prescribed amount of water or oil to plasticize them into an integral mass. The integral mass is pressed and then removed from the frame etc. to obtain a raw product. The raw product is then baked. Otherwise, all the materials are baked within the frame etc. With this method, it is possible to produce patterned baked confectionery. It is also possible to produce a patterned shaped article melted by heating, such as a patterned chocolate shaped article etc. by using particles of the material melted by heating, such as chocolate etc. and melting and fusing the particles by heating.

The materials to be used in the method of this invention are not limited to the aforementioned materials and may be selected depending on the shaped article to be produced. Various shaped articles can be obtained by the use of materials which differ in color, luster, texture and the like in the finished state. Since the sintering step is required in both the methods for producing a ceramic shaped article and a metal shaped article, if a combination of ceramic and metallic materials is used before the sintering step, a cloisonne article can be produced. Since the methods for producing a concrete shaped article and an artificial stone shaped article involve the same step, the materials for the two articles can be combined with each other.

In the method for producing any of the patterned shaped articles, it is desirable to apply vibration when the materials are supplied onto the base surface so as to ensure enough movement of the materials. Further, by rubbing with a brush or comb or applying a jet of air or water to the portion of the boundary between the different kinds of materials for the pattern course, the pattern can be blurred.

In addition, by providing on the base surface or pattern course a mat of nonwoven fabric, paper, or other water- or oil-absorbing material, any excess amount of water, oil, lubricant-bonding agent, plasticizer or solvent can be absorbed and the absorbed amount of water, oil, lubricant-bonding agent, plasticizer or solvent can be supplied to any portion deficient in them to uniformly disperse them in the shaped article. As a result, the ratio of the water (auxiliary agents) in the surface to the cement (resin) becomes small. This means that the strength of the shaped article as a whole is enhanced.

When an air permeable mat is used in the formation of an article under pressure, degassing is enhanced to obtain a dense article. By vibrating or pressing one or both of the pattern course and the backing layer when the two layers are allowed to set into an integral article, the integral article obtained becomes dense and is improved in strength. The article may be reinforced with long fibers, short fibers, wire nets or reinforcing rods by inserting them in or between the two layers. The method using an article obtained by the sheet making method or extrusion molding method and using any plate or sheet as the backing layer is applicable to the production of various articles including architectural panels and boards, wall sheets and tiles. The surface of an existing concrete article can be used as the base surface. In this case, the materials for the pattern course are discharged onto the concrete surface and set to be integral with the existing concrete article.

The finished surface of a shaped article to be obtained can be curved if a deformable mat or a partially or entirely deformable frame is used.

As has been described in the foregoing, this invention uses a retainer having a plurality of small particle-retaining spaces and utilizes small-sized particles as the pre-filling particles in accordance with recent tendency to design diversification and multifunctionality for producing a patterned shaped article to enable the production of a shaped article with a complicated pattern and multifunctionality and satisfy two desires, contradictory from the standpoint of manufacturing technique, that a minute pattern should be expressed by narrowing the particle-retaining spaces and that particles for forming a shaped article that are large enough to be barely accommodated in the spaces narrowed in view of the particle size, shape, adhering power, hardness, weight, etc. of the particles should be used. As a result, it is possible to eliminate the production of defective shaped articles due to the use of complicated particles, enhance the productivity and produce highly functional shaped articles.

The pre-filling particles are given a function in accordance with an object of use, such as a function as a mask when filled in the spaces of a retainer and/or a function having an easy-to-remove property. The pre-filling particles can be removed without being affected by additives given to the shaped article-forming particles in producing a shaped article, such as water, oil, solvent, lubricant-bonding agent, plasticizer, setting agent, etc. or those given to the shaped article-forming particles for the purpose of enhancing the function of a shaped article to be produced, such as viscosity increasing agent, adhesive agent, other such compounds, etc. This can attain rapid expression of a pattern. Further, none of the particle size, shape, hardness, weight, adhering power, etc. of the shaped article-forming particles affects the pre-filling particles. This enables the pre-filled particles to be smoothly removed even under various changes in suction or blow force from the suction or blow nozzle, resulting in enhancement of the productivity and reduction of cost. Furthermore, the pre-filling particles can be recovered and re-used, avoiding environmental pollution and attaining cost reduction. The pre-filling particles can be removed irrespective of the shape of a retainer or the size of the diameter of a suction or blow nozzle, enabling a complicated or minute pattern to be expressed in various forms.

In comparison with the large particles used for the conventionally proposed methods, smaller pre-filling particles are used in the present invention. This can reduce the risk of damaging or wearing off the retainer and the associated appliances and can also reduce the cost of production. When using pre-filling particles having a particle size up to 300 $\mu$m and shaped article-forming particles having a uniform particle size, the pre-filling particles can be replaced with the shaped particle-forming particles at high speeds, resulting in further enhancement of productivity.

What is claimed is:

1. A method for producing a patterned shaped article, which comprises the steps of:

disposing on a base surface a retainer having a plurality of particle-retaining spaces;

filling the spaces with pre-filling particles having a particle size of not more than 600 $\mu$m and easy to remove;

removing the pre-filling particles from part of the spaces to form at least one empty space;

filling the at least one empty space with shaped article-forming particles;

repeating the step of removing the pre-filling particles and the step of filling the shaped article-forming particles until the shaped article-forming particles are substituted for all the pre-filling particles, the shaped article-forming particles comprising at least two kinds of particles;

removing the retainer to form a pattern course on the base surface; and allowing the pattern course to set into an integral mass.

2. The method according to claim 1, wherein the shaped article-forming particles have a fluidity smaller than that of the pre-filling particles.

3. The method according to claim 1, further comprising the step of overlaying a backing layer on the pattern course between the retainer-removing step and the setting step.

* * * * *